United States Patent [19]

Pallini, Jr. et al.

[11] Patent Number: 4,962,952

[45] Date of Patent: Oct. 16, 1990

[54] PRESSURE TUBE WITH DEFLECTING SECTION

[75] Inventors: Joseph W. Pallini, Jr., Tomball, Tex.; Norman Brammer, Fyvie, Scotland; Glenn M. Wald, Spring, Tex.

[73] Assignee: Vetco Gray Inc., Houston, Tex.

[21] Appl. No.: 329,980

[22] Filed: Mar. 29, 1989

[51] Int. Cl.[5] ..... E21B 19/10; F16L 27/00; F16L 51/00

[52] U.S. Cl. ..... 285/24; 285/27; 285/224; 285/140

[58] Field of Search ..... 285/24, 27, 224, 226, 285/140, 142

[56] References Cited

U.S. PATENT DOCUMENTS

| | | | |
|---|---|---|---|
| 3,070,387 | 12/1962 | Peyton . | |
| 3,095,220 | 6/1963 | Johnston et al. . | |
| 3,239,250 | 3/1966 | Fonda-bonardi . | |
| 3,248,130 | 4/1966 | Knight | 285/140 X |
| 3,273,646 | 9/1966 | Walker | 285/140 |
| 3,319,979 | 5/1967 | Herold et al. . | |
| 3,561,527 | 2/1971 | Nelson | 285/142 X |
| 4,350,372 | 9/1982 | Logsdon | 285/226 X |
| 4,469,467 | 9/1984 | Odill et al. | 285/226 X |
| 4,732,396 | 3/1988 | Bringham et al. | 285/226 X |
| 4,819,967 | 4/1989 | Calder et al. | 285/226 X |

*Primary Examiner*—Randolph A. Reese
*Assistant Examiner*—Carol I. Bordas
*Attorney, Agent, or Firm*—James E. Bradley

[57] ABSTRACT

A tube has a deflection section to allow it to align between two bores which are substantially coaxial. The tube has an inner wall, an outer wall, a first end and second end. The first end of the tube rigidly connects to the first member. The second end of the tube slidingly extends into the bore of the second member. The deflecting section has circumferential inner and outer grooves. These grooves extend in from the inner and outer walls of the tube. Each of the grooves has an axial thickness that is much less than the distance between the grooves. The axial thickness is also less than the radial dimension between the base of each groove and the adjacent wall of the tube. This provides substantial rigidity to the deflecitng section, yet allows slight deflection.

4 Claims, 2 Drawing Sheets

PRESSURE TUBE WITH DEFLECTING SECTION

BACKGROUND OF THE INVENTION

1. Field of the Invention

This invention relates in general to subsea well equipment, and in particular to a pressure tube which connects coaxial bores of two members together.

2. Description of the Prior Art

One type of subsea well structure utilizes a subsea wellhead housing. A casing hanger lands in the wellhead housing and supports a string of casing. A wellhead connector is lowered from the surface, landed on top of and connected to the wellhead housing. The wellhead connector has a bore that is coaxial with the bore in the casing hanger. A tube interconnects the two coaxial bores.

At times, the bores may not be precisely aligned. This requires the tube to bend slightly. Elastomeric seals will accommodate some radial movement. However, misalignment is more of a problem with metal seals.

SUMMARY OF THE INVENTION

The tube of this invention interconnects two coaxial bores of a subsea wellhead assembly. The tube has an inner wall, an outer wall, a first end and a second end. One of the ends of the tubes is rigidly connected to the first member. The other end of the tube extends into the bore of the second member. A deflection section is located between the ends of the tube. The deflecting section is made up of inner and outer grooves formed in the wall of the tube. The grooves are circumferential. The inner and outer grooves alternate with each other along the axis of the tubing.

The axial dimension of the grooves is substantially less than the axial distance between the grooves. This provides substantial axial strength to the tube. Also, the radial distance from the inner wall of the tube to each outer groove, and the radial distance from the outer wall of the tube to each inner groove is much greater than the axial dimension of each groove. Both of these together provide substantial strength to withstand high pressure.

In one embodiment, the second end of the tube is free for slight axial movement within the bore of the second member. In another embodiment, the second end of the tube bears against a shoulder in the second member. The length of the tube is selected to compress the second end against this shoulder for a metal-to-metal seal. The radial depths of the grooves are selected in the second embodiment to provide an axial force upon application of internal pressure, or selected to provide axial force from external pressure, or both.

DESCRIPTION OF THE PREFERRED EMBODIMENT

Figure 1:
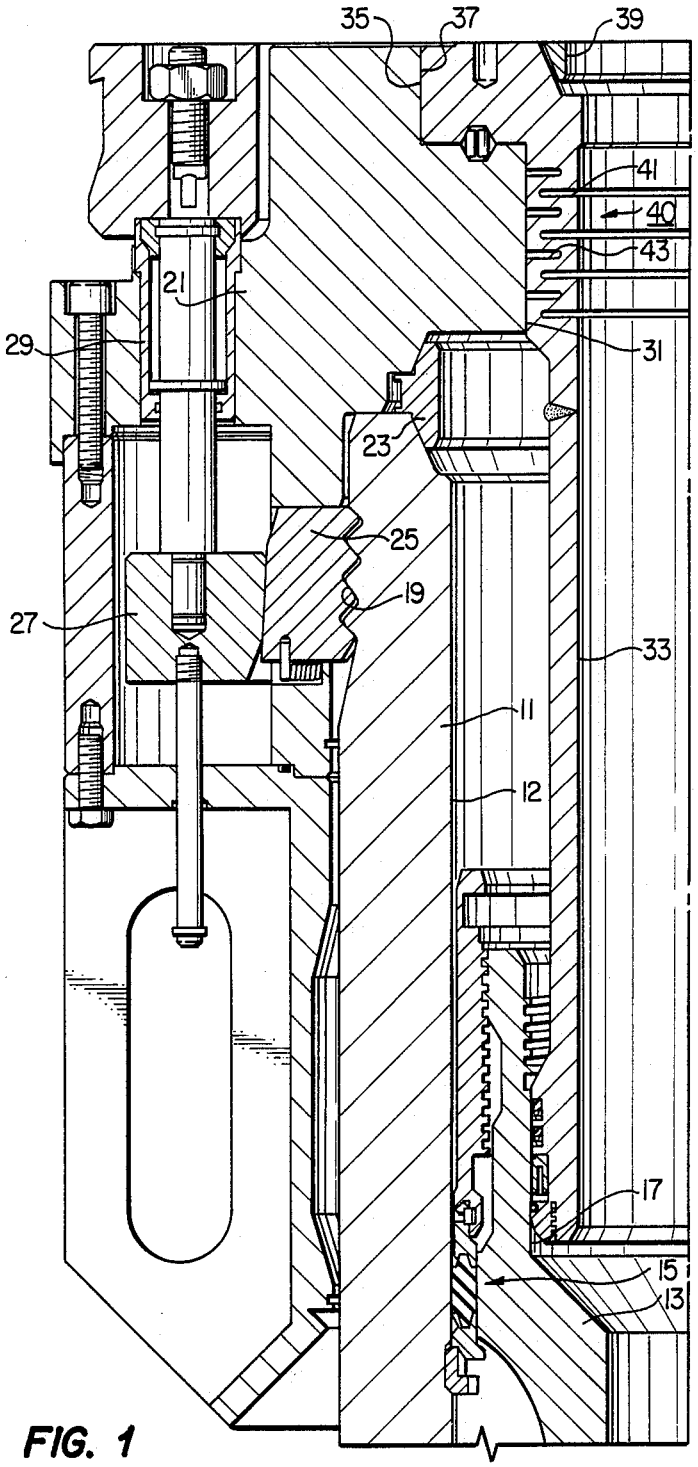
FIG. 1 is a vertical sectional view illustrating a portion of a wellhead having a tube constructed in accordance with this invention.

Referring to FIG. 1, wellhead housing 11 will be of a type that is supported on a sea floor. Wellhead housing 11 has a bore 12 which contains at least one casing hanger 13. The casing hanger 13 is a conventional member that is located at the upper end of a string of casing (not shown). A packoff 15 seals between the exterior of the casing hanger 13 and the wellhead housing 11. The casing hanger 13 has a cylindrical bore 17.

A set of exterior grooves 19 are located on the wellhead housing 11. A wellhead connector 21 lands on top of the wellhead housing 11. The wellhead connector 21 will be connected to the lower end of a string of riser (not shown) which extends to a drilling or production vessel at the surface. A seal 23 seals between the wellhead connector 21 and the wellhead housing 11. A plurality of dogs 25 carried in the wellhead connector 21 engage the grooves 19. A cam 27 moves from an upper position to a lower position, pushing the dogs 25 inward into the engaged position. A hydraulic cylinder 29 serves to move the cam 27 between the upper and lower positions.

The wellhead connector 21 has a bore 31 which is coaxial with the bore 17 of the casing hanger 13. A tube 33 extends between the bore 31 and the bore 17 to seal the interior of these bores from the bore 12 of the wellhead housing 11. Tube 33 has an upper or first end which rigidly attaches the tube 33 to the wellhead connector 21. The means for attachment includes an integral flange 35 located on the upper end of the tube 33. Flange 35 fits within a counterbore 37 located in the wellhead connector 21. A metal seal 39 seals the upper end of the tube 33. The lower termination of a riser (not shown) will be connected to the upper end of the tube 33 and to the wellhead connector 21.

Tube 33 has a second end that extends into the casing hanger bore 17. Tube 33 has an integrally formed deflection section 40 which allows slight axial and bending deflection. Bending deflection in section 40 allows radial deflection of the lower end of tube 33. The deflection section 40 is located entirely within the bore 31 of the wellhead connector 21. The axial length of the deflection section 40 may be as much as one-half the total length of the tube 33 from the flange 35 to the lower or second end. Deflection section 40 includes a plurality of inner grooves 41 and outer grooves 43. All of the grooves 41, 43 are cut into an enlarged section of the solid wall of the tube 33.

All of the grooves 41, 43 are located in planes perpendicular to the axis of the tube 33. The inner grooves 41 extend outward from the inner wall 42 of the tube 33. The outer grooves 43 extend inward from the outer wall 44 of the tube 33. The grooves 41, 43 are staggered, with an inner groove 41 located between each outer groove 43. The radial extent or dimension of each groove 41, 43 is greater than one-half the radial distance from the inner wall 42 to the outer wall 44.

Figure 2:
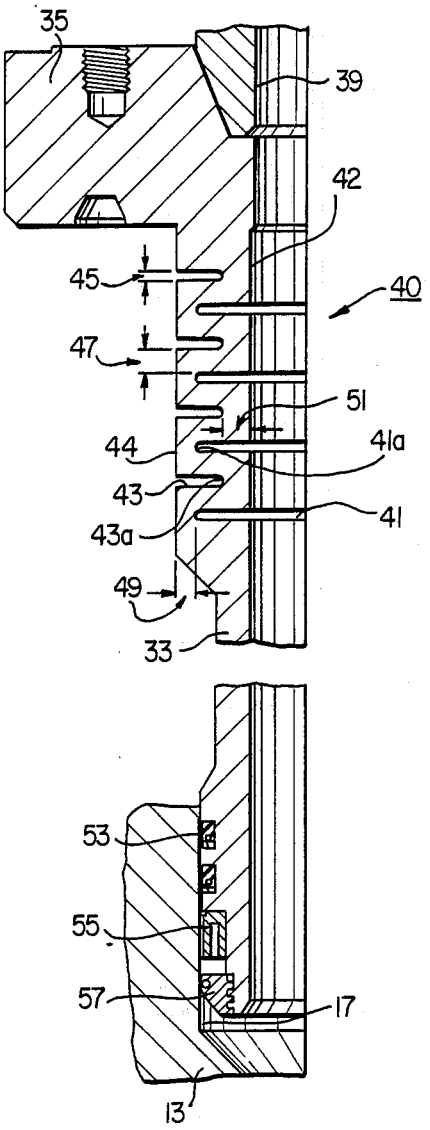
FIG. 2 is a partial sectional view of the tube shown in FIG. 1.

The deflecting area is sized so that it is substantially rigid both in radial and axial directions, capable of only slight deflection of about 2 to 5 percent. This is accommodated by making the grooves 41, 43 rather thin compared to the metal cross-section in the deflecting section 40. Each groove 41, 43 preferably has the same axial dimension or thickness 45, as shown in FIG. 2. Each groove, 41, 43 preferably is positioned the same axial distance 47 from one of the grooves 41 to the next groove 43. The axial thickness 45 is much less than the axial distance 47, preferably about one-half.

Also, to assure proper strength of the deflecting section 40, there is a fairly large outer radial distance 49 between the bottom or base **41*a* of each inner groove 41** and the outer wall 44. There is also a fairly large inner radial distance 51 between the inner wall 42 and the base 43*a* of each outer groove 43. The inner radial distance 51 and the outer radial distance 49 are not necessarily equal. However, each is substantially larger than the axial thickness 45 of each groove 41, 43. Preferably, the inner radial distance 51 and the outer radial distance 49 are each about twice the magnitude of the axial thickness 45 of each groove 41, 43.

The lower or second end of the tube 33 has a plurality of elastomeric seals 53 that sealingly engage the bore 17 of the casing hanger 13. A metal seal 55 provides metal-to-metal sealing between the tube 33 and the bore 17. A retainer 57 holds the metal seal 55 in place.

The radial lengths of the inner grooves 41 and the outer grooves 43 can be varied to provide minimum axial loading due to pressure. Axial force or loading can result from pressure being applied to the interior or exterior of the tube 33. For example, if the only pressure expected is to be internal, the pressure in the tube 33 will tend to force the axial thickness of the inner grooves 41 to increase. The tube 33 will tend to elongate. This internal pressure also acts on the metal seal 55, tending to compress the tube 33. If the base 41*a* of each inner groove 41 has the same diameter as the bore 17 at seal 55, as shown in FIG. 2, then the compression and tension forces will offset each other. There will be no axial stress in the tube 33 in that case as a result of internal pressure.

Similarly, if only external pressure is expected, the base 43*a* of each outer grooves 43 can be selected to equal the diameter of bore 17 to balance axial forces on the tube 33 due to external pressure. If both internal and external forces are expected, the radial depths of the grooves 41, 43 can be selected to reduce the axial forces on the tube 33 to a minimum.

In operation, casing hanger 13 will be landed in the wellhead housing 11. Packoff 15 is set between the casing hanger 13 and the wellhead housing 11. The tube 33 will be fastened to the wellhead connector 21. The wellhead connector 21 is lowered over the wellhead housing 11. The tube 33 will insert into the bore 17 of the casing hanger 13. Slight radial deflection in the deflecting section 40 allows the tube 33 to move laterally slightly to align with the bore 17 even though the bore 17 may be slightly out of alignment with the axis of the bore 31. This assures that the metal seal 55 (FIG. 2) seals properly.

In the alternate embodiment of FIG. 3, the bore 17' of casing hanger 13' has a frusto-conical shoulder 59 directly below a cylindrical portion of the bore 17'. Elastomeric seals 53' on the lower end of the tube 33' seal against the cylindrical portion of the bore 17'. Shoulder 59 tapers relative to vertical at about 10 degrees. The tube 33' has a shoulder 61 below the seals 53' which tapers relative to vertical at about 8 degrees.

The tube 33' is sized so that it will compress slightly in the deflection section 40' when the shoulder 61 contacts the shoulder 59. This preloads the shoulder 61 against the shoulder 59, providing a metal-to-metal seal. The difference in the angles of 10 degrees and 8 degrees between the shoulders 59 and 61 assures a metal-to-metal contact. Preferably, the diameter of the base of each outer groove 43' has a diameter that is less than the inner diameter of the bore 17' immediately above shoulder 59.

Figure 3:
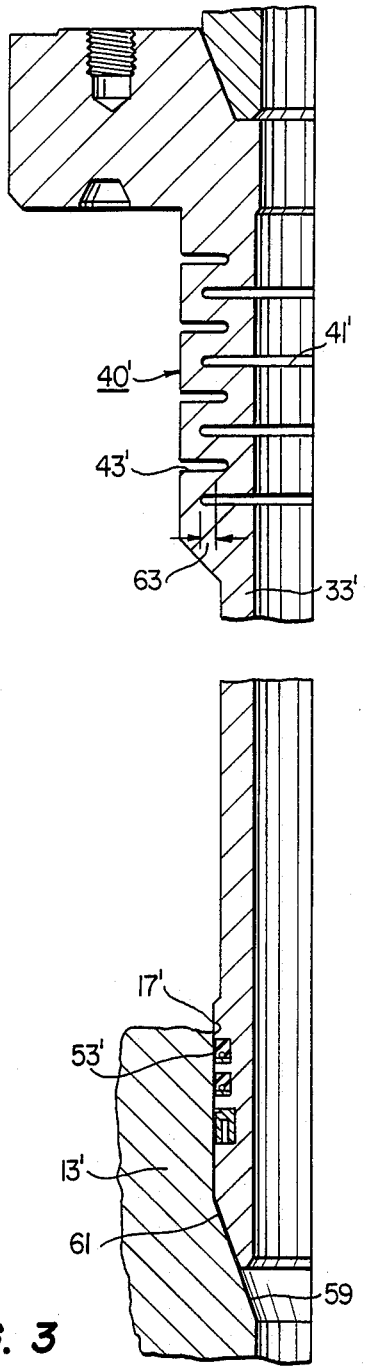
FIG. 3 is a partial sectional view of an alternate embodiment of a tube.

The embodiment of FIG. 3 preferably has inner grooves 41' sized to provide a positive axial compressive force on tube 33' when under internal pressure. The base of each inner groove 41' is greater in diameter than the inner diameter of bore 17' immediately above shoulder 59 by a difference 63. Internal pressure will tend to elongate the tube 33', increasing the compressive force between the shoulder 61 and shoulder 59. This tends to increase the ability of the metal seal formed by the shoulders 59, 61 to withstand internal pressure.

The invention has significant advantages. The deflecting member in the tube allows slight radial deflection to accommodate for slightly misaligned bores. This deflecting section is sufficiently strong due to the thin size of the groove to withstand great pressures. The deflecting section will also transmit axial load in the event that the tube is preloaded axially against the shoulder in the casing hanger. The grooves may be dimensioned in radial directions to balance axial forces due to pressure, or to provide a compressive axial force.

While the invention has been shown in only two of its forms, it should be apparent to those skilled in the art that it is not so limited, but is susceptible to various changes without departing from the scope of the invention.

We claim:

1. In a first member mounted to a second member, both members having substantially coaxial bores which are axially spaced from each other, an improved means for connecting the bores, comprising in combination:

a metal tube having an inner wall, an outer wall, a first end and a second end;

means on the first end of the tube for connecting the first end of the tube to the first member with the interior of the tube in sealing communication with the bore of the first member;

the second end of the tube extending into the second member, with the outer wall of the tube sealingly engaging the bore of the second member;

a deflecting section in the tube for aligning the second end of the tube with the bore of the second member, the deflecting section having a plurality of circumferential inner grooves extending from the inner wall outward a selected distance;

the deflecting section having a plurality of circumferential outer grooves extending from the outer wall inward, the inner grooves and outer grooves alternating from each other in an axial direction; and each of the inner and outer grooves having an axial thickness, and each of the inner grooves being axially spaced from one of the outer grooves an axial distance, said axial thickness being less than said axial distance.

2. In a first member mounted to a second member, both members having substantially coaxial bores which are axially spaced from each other, an improved means for connecting the bores, comprising in combination:

a metal tube having an inner wall, an outer wall, a first end and a second end;

means on the first end of the tube for connecting the first end of the tube to the first member with the interior of the tube in sealing communication with the bore of the first member;

the second end of the tube extending into the bore of the second member;

seal means on the outer wall of the tube for sealingly engaging the bore of the second member;

a deflecting section in the tube having a plurality of circumferential inner grooves extending from the inner wall outward a selected distance;

the deflecting section having a plurality of circumferential outer grooves extending from the outer wall inward, the inner grooves and outer grooves alternating from each other in an axial direction;

each of the inner and outer grooves having an axial thickness, and each of the inner grooves being axially spaced from one of the outer grooves by an axial distance, said axial thickness being substantially less than said axial distance;

each of the outer grooves having a base at an inner radial distance from the inner wall of the tube;

each of the inner grooves having a base at an outer radial distance from the outer wall of the tube; and said inner radial distance and said outer radial distance each being substantially greater than said axial thickness of the grooves.

3. In a first member mounted to a second member, both members having substantially coaxial bores which are axially spaced from each other, an improved means for connecting the bores, comprising in combination:

a metal tube having an inner wall, an outer wall, a first end and a second end;

means on the first end of the tube for connecting the first end of the tube to the first member with the interior of the tube in sealing communication with the bore of the first member;

a conical shoulder in the bore of the second member;

the second end of the tube extending into the bore of the second member, with the outer wall of the tube sealingly engaging the bore of the second member and with the second end bearing against the shoulder in the second member;

a deflecting section in the tube having a plurality of circumferential inner grooves extending from the inner wall outward a selected distance;

the deflecting section having a plurality of circumferential outer grooves extending from the outer wall inward, the inner grooves and outer grooves alternating from each other in an axial direction;

each of the inner and outer grooves having an axial thickness, and each of the inner grooves being axially spaced from one of the outer grooves an axial distance, said axial thickness being less than said axial distance;

the length of the tube being selected so as to axially compress the deflecting section slightly to provide an axial preload force of the second end of the tube against the shoulder of the second member;

the outer grooves each having a base at an inner radial distance from the inner wall of the tube;

the inner grooves each having a base at an outer radial distance from the outer wall of the tube; and said inner radial distance and said outer radial distance each being greater than said axial thickness of the grooves.

4. In a first member mounted to a second member, both members having substantially coaxial bores which are axially spaced from each other, an improved means for connecting the bores, comprising in combination:

a metal tube having an inner wall, an outer wall, a first end and a second end;

means on the first end of the tube for connecting the first end of the tube to the first member with the interior of the tube in sealing communication with the bore of the first member;

a conical shoulder in the second member;

the second end of the tube extending into the second member, with the outer wall of the tube sealingly engaging the bore of the second member and with the second end bearing against the shoulder in the second member;

a deflecting section in the tube having a plurality of circumferential inner grooves extending from the inner wall outward a selected distance;

the deflecting section having a plurality of circumferential outer grooves extending from the outer wall inward, the inner grooves and outer grooves alternating from each other in an axial direction;

each of the inner and outer grooves having an axial thickness, and each of the inner grooves being axially spaced from one of the outer grooves an axial distance, said axial thickness being less than said axial distance;

the length of the tube being selected so as to axially compress the deflecting section slightly to provide an axial preload force of the second end of the tube against the shoulder of the second member;

the outer grooves each having a base at an inner radial distance from the inner wall of the tube;

the inner grooves each having a base at an outer radial distance from the outer wall of the tube;

said inner radial distance and said outer radial distance each being greater than said axial thickness of the grooves;

the base of each of the inner grooves having a diameter, the bore of the second member immediately above the shoulder having an inner diameter that is less than the diameter of the base of each inner groove, so that pressure within the tube urges the second end of the tube more tightly against the shoulder; and the base of each of the outer grooves having a diameter that is less than said inner diameter of the bore of the second member.

* * * * *